US010820106B2

(12) United States Patent
Gu

(10) Patent No.: US 10,820,106 B2
(45) Date of Patent: Oct. 27, 2020

(54) SPEAKER MODULE

(71) Applicant: AAC Technologies Pte. Ltd., Singapore (SG)

(72) Inventor: Xiaojiang Gu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/533,792

(22) Filed: Aug. 7, 2019

(65) Prior Publication Data

US 2020/0053470 A1 Feb. 13, 2020

(30) Foreign Application Priority Data

Aug. 13, 2018 (CN) ..... 2018 2 1302271 U

(51) Int. Cl.
*H04R 9/02* (2006.01)

(52) U.S. Cl.
CPC ..... *H04R 9/025* (2013.01)

(58) Field of Classification Search
None
See application file for complete search history.

(56) References Cited

U.S. PATENT DOCUMENTS 5,933,508 A * 8/1999 Fuke ..... H04R 1/30 381/343
2007/0140521 A1* 6/2007 Mitobe ..... H04R 9/046 381/420
2007/0274557 A1* 11/2007 Chiba ..... H04R 9/02 381/412
2011/0123061 A1* 5/2011 Kamimura ..... H04R 9/025 381/412
2016/0057541 A1* 2/2016 Porter ..... H04R 9/025 381/412
2018/0081406 A1* 3/2018 Kita ..... H04R 11/02
2018/0302722 A1* 10/2018 Linghu ..... H04R 7/18

* cited by examiner

*Primary Examiner* — Tuan D Nguyen
(74) *Attorney, Agent, or Firm* — W&G Law Group LLP

(57) ABSTRACT

The present disclosure provides a speaker module. The speaker module comprises a frame having side walls, a magnetic circuit system and a vibration system housed in the frame. The vibration system comprises a diaphragm fixed on the side wall and a voice coil for driving the diaphragm to vibrate. The magnetic circuit system comprises a magnet and a yoke for accommodating the magnet. The yoke is disposed on the side wall and enclosing a receiving space with the side wall. A sound cavity of the speaker module is formed between the diaphragm and the yoke, the yoke comprises an upper surface adjacent to the diaphragm and a lower surface away from the diaphragm, and the yoke is provided with a plurality of micropores arranged in an array through the upper surface and the lower surface. The gas in the rear sound cavity leaks to the outside of the speaker module.

10 Claims, 3 Drawing Sheets

SPEAKER MODULE

FIELD OF THE DISCLOSURE

The present disclosure relates to electro-acoustic transducers, and more particularly to a speaker module applied in a portable electronic device.

DESCRIPTION OF RELATED ART

With the arrival of the mobile Internet era, the number of smart mobile devices is increasing. Among many mobile devices, mobile smart phones are undoubtedly the most common and most portable mobile devices. At present, the functions of mobile phones are extremely diverse, one of which is the high-quality music function, and the speaker in mobile phones is one of the necessary elements to achieve this high-quality music function.

The speaker module usually comprises a frame, an upper cover, a vibration system housed in the frame and the magnetic circuit system driving the vibration system to vibrate. The magnetic circuit system comprises a yoke and a magnet. The yoke and the frame cooperate to form a relatively independent accommodation space from the outside world.

In the related art, there usually provides some vent holes in the yoke to balance the internal air pressure to ensure the stability of the vibration of the vibration system. In order to prevent foreign matter from entering into the vibration system, it is usually necessary to attach a damping film to the surface of the vent hole. This requires an additional process of attaching the damping film, which increases the production cost of the product.

Therefore, it is desired to provide a speaker module to overcome the aforesaid problems.

BRIEF DESCRIPTION OF THE DRAWINGS

Many aspects of the exemplary embodiments can be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

The present disclosure will hereinafter be described in detail with reference to several exemplary embodiments. To make the technical problems to be solved, technical solutions and beneficial effects of the present disclosure more apparent, the present disclosure is described in further detail together with the figure and the embodiments. It should be understood the specific embodiments described hereby is only to explain the disclosure, not intended to limit the disclosure.

Figure 1:
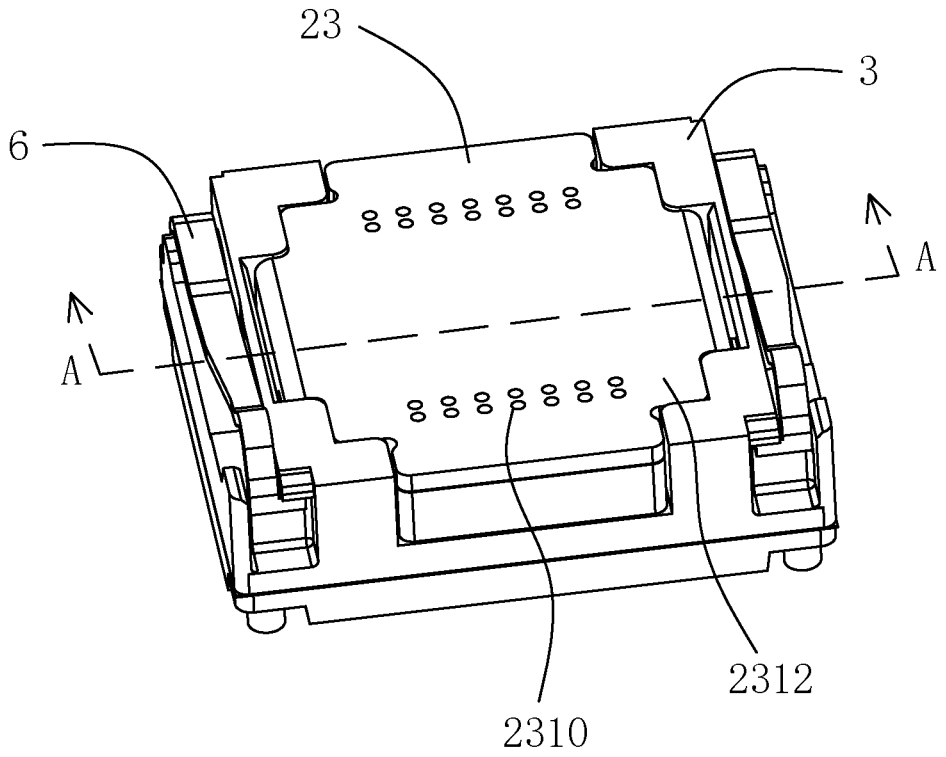
FIG. 1 is a schematic diagram of a three-dimensional structure of the speaker module in accordance with an exemplary embodiment of the present disclosure.
Figure 2:
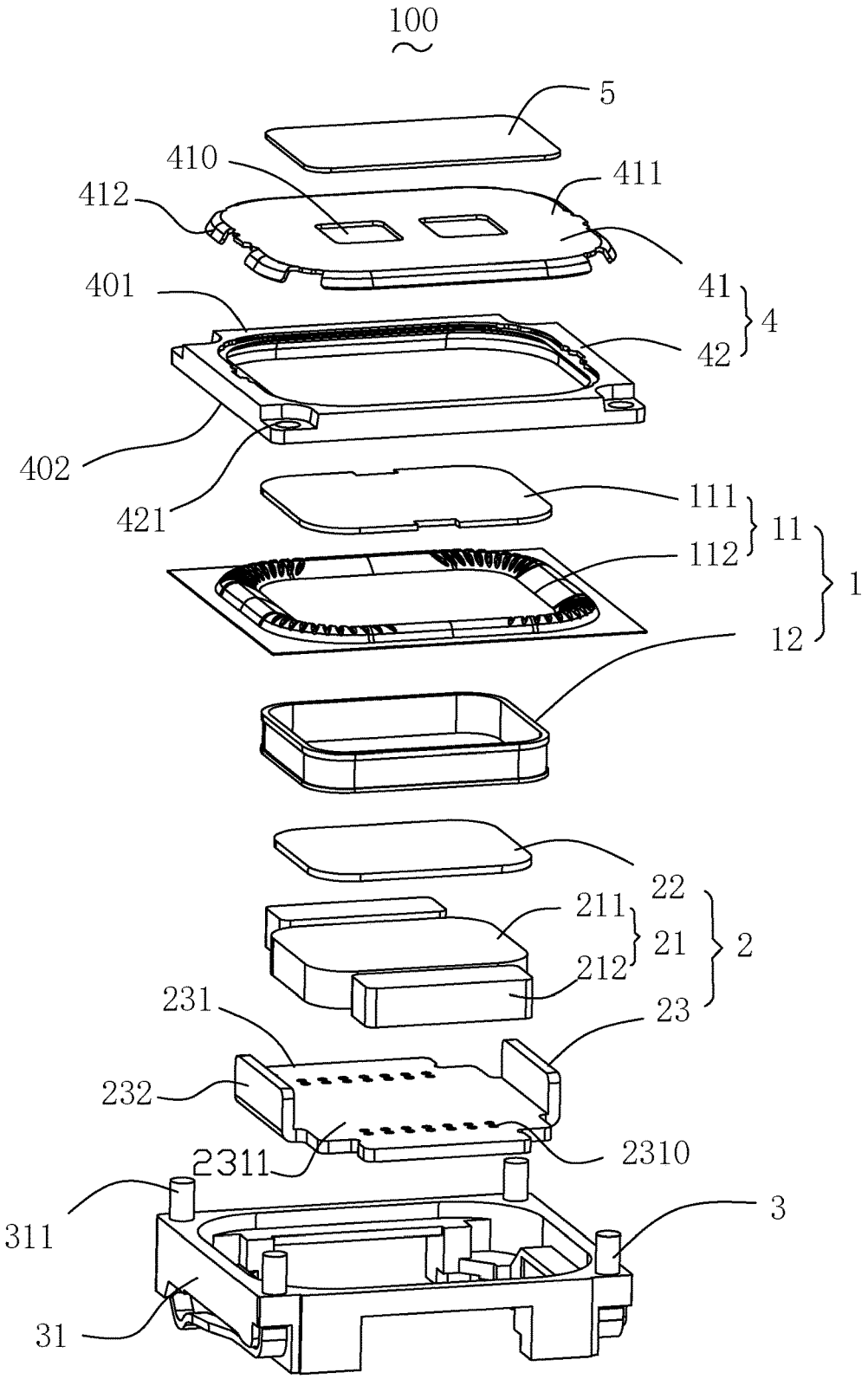
FIG. 2 is an exploded view of a three-dimensional structure of the speaker module shown in FIG. 1.
Figure 3:
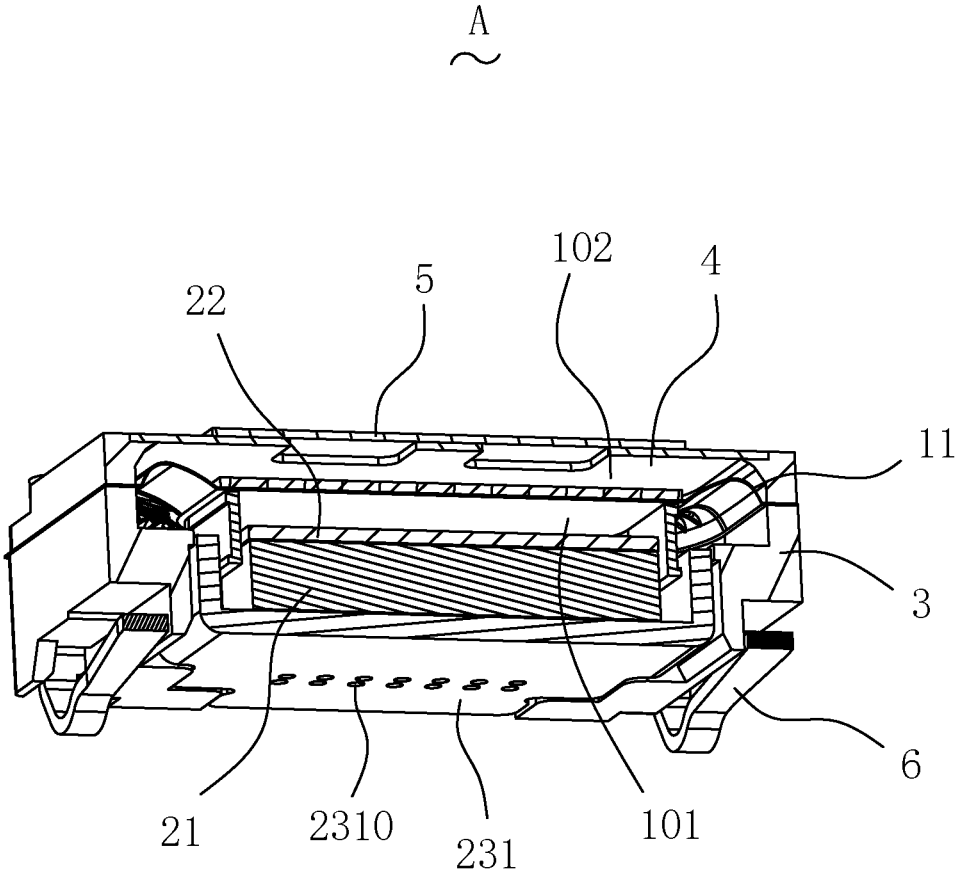
FIG. 3 is a cross-sectional view along the line A-A in the perspective view shown in FIG. 1.

Please also refer to FIG. 1 to FIG. 3, wherein FIG. 1 is a schematic perspective view of a speaker module according to a preferred embodiment of the present disclosure, and FIG. 2 is an exploded view of the speaker module shown in FIG. 1, and FIG. 3 is a cross-sectional view along the line A-A in the perspective view shown in FIG. 1. The present disclosure provides a speaker module 100, which comprises a vibration system 1, a magnetic circuit system 2, a frame 3 for housing the vibration system 1 and the magnetic circuit system 2, and an upper cover 4 for covering the frame 3.

The vibration system 1 comprises a diaphragm 11 and a voice coil 12 for driving the diaphragm to vibrate. The voice coil 12 is wound by a voice coil lead. The diaphragm 11 comprises a dome 111 and a suspension 112 surrounding the dome 111. In the present embodiment, the dome 111 and the suspension 112 are of a separate structure, the dome 111 is attached to the top of the suspension 112, and the upper surface of the voice coil 12 abuts against the bottom of the suspension 112. Of course, in other alternative embodiments, the dome 111 may also be disposed at the bottom of the suspension 12, and the dome 111 and the suspension 112 may also be of integral structure, both of which may be implemented.

The magnetic circuit system 2 comprises a magnet 21, a pole plate 22 attached on the magnet 21, and a yoke 23 accommodating the magnet 21 and the pole plate 22. The magnet 21 comprises a centrally located main magnet 211 and a secondary magnet 212 surrounding the main magnet 211. The main magnet 211 is a rectangular permanent magnet disposed on the center of the yoke 23, and the secondary magnet 212 has two in total, which are elongated magnets respectively located on both sides of the main magnet 211. The pole plate 22 is made of a magnetic conductive material and is attached to the surface of the main magnet 211 for magnetic conduction and converging magnetic fields to improve the magnetic induction performance of the product.

Specifically, the yoke 23 comprises a bottom plate 231 and a side plate 232 that is bend and extended from the bottom plate 231. In the present embodiment, the bottom plate 231 has an elongated structure, and two side plates 232 are disposed on the two short-axis sides of the bottom plate 231, and the secondary magnet 212 is disposed on the two long-axis sides of the bottom plate 231. That is, the secondary magnet 212 is not on the same side of the bottom plate 231 with the side plate 232. A magnetic gap is formed between the main magnet 211 and the secondary magnet 212, and between the main magnet 211 and the side plate 232. The voice coil 12 is inserted into the magnetic gap, and is forced in the magnetic gap during electrification to drive the diaphragm 11 to vibrate in the vertical direction.

As shown in FIG. 3, the frame 3 comprises a side wall 31 that encloses a receiving space. The diaphragm 11 is attached to a side surface of the side wall 31 close to the upper cover 4. The diaphragm 11 is fixedly interposed between the frame 3 and the upper cover 4. The side plate 232 abuts against the inner surface of the side wall 31. The bottom plate 231 covers the bottom of the side wall 31 and encloses a receiving space of the speaker module 100 with the frame 3 and the upper cover 4. A rear sound cavity 101 of the speaker module 100 is formed between the diaphragm 11 and the bottom plate 231 of the yoke 23. The front sound cavity 102 of the speaker module 100 is formed between the diaphragm 11 and the upper cover 4.

The bottom plate 23 comprises an upper surface 2311 adjacent to the diaphragm 11 and a lower surface 2312 away from the diaphragm 11. The yoke 23 is provided with a plurality of micropores 2310 arranged in an array extending through the upper surface 2311 and the lower surface 2312, and the gas in the rear sound cavity 101 leaks through the micropores 2310 to the outside of the speaker module 100. Thus, the air pressure generated by the gas in the acoustic cavity after the diaphragm 11 is compressed during the vibration can leak out of the speaker module through the micropores 2310, so that the acoustic performance can be stabilized. Preferably, the micropore array formed by the micropores has two groups and is arranged along the long axis direction, and the two micropores arrays are symmetrically disposed on both sides of the bottom plate 23.

The diameter of the micropores 2310 ranges from 0.15 mm to 0.3 mm. In this diameter range, leakage of the speaker module can be achieved, and foreign matter or dust can be prevented from entering the speaker module. In the production process of the product, the acoustic effect of the speaker module can be adjusted by adjusting the number of micropores and the aperture size of the micropores; when the number of micropores is large or the aperture size is large, the amplitude of the diaphragm is large, and the sound pressure level SPL (sound pressure) is higher and the distortion is lower; when the number of holes of the micro pores is small or the aperture size is small, the amplitude is small, the SPL is small, and the distortion is increased. By adjusting the number and aperture size of the micropores, the acoustic performance of the product can be adjusted to meet different needs.

Further, the upper cover 4 comprises a main body portion 41 and a plastic layer 42 surrounding the main body portion 41. The upper cover 4 comprises an upper surface 401 away from the diaphragm 11 and a lower surface 402 adjacent to the diaphragm 11. The main body portion 41 is provided with a sound outlet 410 penetrating the upper surface 401 and the lower surface 402, a damping film covering the sound outlet 410 is attached to the upper surface 401 of the upper cover 4, and the sound outlet 410 and the diaphragm 11 corresponding settings. Specifically, in the present embodiment, the main body portion 41 is a steel sheet integrally molded with the plastic layer 42.

Further, the steel sheet comprises a flat portion 411 and an extending portion 412 extending from the edge of the flat portion 411, and the extending portion 412 is integrally molded into the plastic layer 42.

Further, the surface of the side wall 31 of the frame 3 adjacent to the upper cover 4 is provided with a fixing post 311, and the upper cover 4 is provided with a fixing hole 421 matched with the fixing post 311. Specifically, in the embodiment, the fixing hole 421 is disposed at the four corners of the plastic layer 42. Further, the frame 3 is further provided with a conductive terminal 6 electrically connected to the outside.

The speaker module of the present invention comprises a frame having side walls, a magnetic circuit system and a vibration system housed in the frame. The vibration system including a diaphragm fixed on the side wall and a voice coil for driving the vibration to vibrate. The magnetic circuit system comprising a magnet and a yoke for accommodating the magnet, the yoke is disposed on the side wall and enclosing a receiving space of the speaker module with the side wall, a sound cavity of the speaker module is formed between the diaphragm and the yoke, the yoke comprises an upper surface adjacent to the diaphragm and a lower surface away from the diaphragm. There are a plurality of micropores arranged in an array extending through the upper surface and the lower surface. The gas in the rear sound cavity leaks to the outside of the speaker module. The speaker module of the utility model can provide a plurality of micropores arranged in an array on the yoke, and can realize leakage and dustproof functions without additionally attaching a dustproof net, and can effectively reduce the production cost.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A speaker module, comprising:
- a frame having a side wall;
- a vibration system accommodated in the frame, comprising:
  - a diaphragm fixed to the side wall, and
  - a voice coil for driving the diaphragm to vibrate;
- a magnetic circuit system accommodated in the frame, comprising:
  - a yoke; and
  - a magnet accommodating in the yoke, wherein the yoke is assembled in the side wall and defines a receiving space of the speaker module with the side wall, a rear sound cavity of the speaker module is formed between the diaphragm and the yoke, the yoke comprises an upper surface adjacent to the diaphragm and a lower surface away from the diaphragm, a plurality of micropores are arranged in an array through the upper surface and the lower surface, gas from the rear sound cavity leaks out to the outside of the speaker module through the micropores.

2. The speaker module as described in claim 1, wherein the diameter of the micropores ranges from 0.15 mm to 0.3 mm.

3. The speaker module as described in claim 1, wherein the yoke comprises a bottom plate and a side plate bend and extend from the bottom plate, the side plate abuts an inner surface of the side wall, and the micropores is disposed on the bottom plate.

4. The speaker module as described in claim 3, wherein the amount of the side plates two in total and two side plates are disposed on the two short-axis sides of the bottom plate.

5. The speaker module as described in claim 4, wherein the micropore array formed by the micropores is arranged along the long axis direction.

6. The speaker module as described in claim 5, wherein the micropore array formed by the micropores has two groups, and is symmetrically disposed on both sides of the bottom plate.

7. The speaker module as described in claim 6, wherein the speaker module further comprises an upper cover that covers the frame, the upper cover and the frame are clamped and fixed with the diaphragm, and a front sound cavity is formed between the upper cover and the diaphragm.

8. The speaker module as described in claim 7, wherein the upper cover comprises a main body portion and a plastic layer surrounding the main body portion, and the main body portion is provided with a sound outlet extending through the upper surface and the lower surface, and the sound outlet is disposed corresponding to the diaphragm.

9. The speaker module as described in claim 8, wherein a damping film covering the sound outlet is attached to the upper surface of the upper cover.

10. The speaker module as described in claim 8, wherein the main body portion is a steel sheet integrally molded on the plastic layer.

* * * * *